United States Patent [19]

Clauss et al.

[11] 3,994,694

[45] Nov. 30, 1976

[54] COMPOSITE NICKEL-IRON ELECTROPLATED ARTICLE

[75] Inventors: Richard John Clauss, Allen Park; Robert Arnold Tremmel, Woodhaven, both of Mich.

[73] Assignee: Oxy Metal Industries Corporation, Warren, Mich.

[22] Filed: Mar. 3, 1975

[21] Appl. No.: 554,843

[52] U.S. Cl. ..... 29/194; 204/41; 29/196.6

[51] Int. Cl.[2] ..... B23P 3/00

[58] Field of Search ..... 204/40, 41, 43 T; 29/196.6, 194; 340/174 QA

[56] References Cited

UNITED STATES PATENTS

| | | | |
|---|---|---|---|
| 3,451,793 | 6/1969 | Matsushita | 29/194 |
| 3,480,522 | 11/1969 | Brownlow | 204/40 |
| 3,488,167 | 1/1970 | Chang et al. | 29/196.1 |
| 3,525,677 | 8/1970 | Austen | 204/43 T |
| 3,645,857 | 2/1972 | Fisher et al. | 204/28 |
| 3,716,464 | 2/1973 | Kovac | 204/43 T |
| 3,812,566 | 5/1974 | Clauss | 29/183.5 |
| 3,878,067 | 4/1975 | Tremmel | 204/43 T |

FOREIGN PATENTS OR APPLICATIONS

| | | | |
|---|---|---|---|
| 2,007,304 | 1/1970 | France | 204/40 |
| 1,136,491 | 12/1968 | United Kingdom | 204/40 |

OTHER PUBLICATIONS

G. H. Cockett et al., J. Electrochem. Soc., pp. 906–908, vol. 108, No. 9 (1961).

*Primary Examiner*—G. L. Kaplan
*Attorney, Agent, or Firm*—B. F. Claeboe

[57] ABSTRACT

Substantially improved results by way of durability and appearance are accomplished by electrodepositing upon a metallic substrate a plurality of layers of a nickel-iron alloy, the lowermost of which has a relatively high iron content and the uppermost a relatively lower iron content, upon which is electrochemically bonded a nickel layer and an upper layer of microdiscontinuous chromium or equivalent decorative finishing material.

8 Claims, No Drawings

COMPOSITE NICKEL-IRON ELECTROPLATED ARTICLE

BACKGROUND OF THE INVENTION

It is known in the art to which this invention pertains to provide a composite metallic structure in which the base material is generally copper, steel or the like upon which is electroplated an essentially sulfur-free semi-bright nickel coating. In this composite coating, there is then electrochemically deposited a sulfur containing bright nickel layer upon which is electroplated a chromium layer. While the electrobonded combination as just described fulfilled a need long existing in the art by way of brightness, leveling, ductility and plating rate, it has now been found after substantial exposure to corrosive environments that the durability and appearance of the electroplated end product can be more economically achieved if the essentialy sulfur-free semi-nickel coating and the upper sulfur containing bright nickel chromium deposit and supplanted by a first layer upon the copper or like substrate a relatively high nickel-iron deposit upon which is electroplated a nickel-iron deposit having a relatively low iron content, followed by a top nickel layer which induces microdiscontinuities in the chromium or like overcoating. In this manner, substantially improved results by way of durability and appearance of the finish are accomplished.

SUMMARY OF THE INVENTION

It has now been discovered that by using a plurality of electroplated layers of nickel-iron alloy in which one of the layers is relatively high in iron and another of the layers is relatively lower in iron content, a highly durable and extremely attractive appearance can be achieved without straining. It is also within the purview of this invention that the reduction of iron content can also be achieved by stages of more than two steps. Illustratively, it is possible to use air agitation for the high iron content, moderate agitation as a second step to reduce the iron content, and essentially no agitation for the low iron content in the final layer just before the nickel strike which creates microdiscontinuities in the chromium layer. It is obvious that this succession of steps may be accomplished in a single solution or in a plurality of solutions.

DESCRIPTION OF THE PREFERRED EMBODIMENTS

The substrate upon which the electroplating is to be accomplished is generally a metallic surface exemplified by steel, copper or brass. If the substrate should be an electroplated copper deposit, a typical thickness is about 10 $\mu$m but again, this depends upon the ultimate application.

The plating thickness of the lowermost layer of the duplex nickel-iron composite for relatively severe exposure conditions is typically 10 $\mu$m or more, however, this may of course be varied depending upon such factors as cost considerations and the degree of protection required. The initial iron-nickel alloy which is electroplated upon a suitable substrate is relatively high in iron content, as for example, between about 15 to 40% iron by weight. The superimposed iron-nickel alloy, as has been stated, is relatively lower in iron content and the percent of iron by weight may vary from about 5 to 14%. Due to the significant reduction in iron content when little or no agitation of the plating solution is used, it is anticipated that even alloys containing as much as 40% iron followed by nickel-iron layers of 5 to 14% iron and overplated with nickel and microdiscontinuous chromium, the stain would be significantly reduced.

This relatively lower iron containing deposit preferably is in the range in thickness of between about 2.5 to 10 $\mu$m. The iron-nickel alloy electrodeposited in the two layers or more than two layers is obtained by electrolyzing a bath containing one or more salts of nickel, one or more salts of iron and a bath soluble complexing agent. A suitable bath soluble nickel brightener which may also be added is that disclosed in U.S. Pat. No. 3,806,429, which is commonly assigned.

In order to introduce iron and nickel ions into the bath, any bath soluble iron or nickel containing compound may be employed, however, the corresponding anion must not be detramental to the bath, as is well known. Preferably, inorganic nickel salts are employed, such as nickel sulfate, nickel chloride and the like, as well as other nickel bearing compounds such as nickel sulfamate and related compounds.

The inorganic salts of iron which have worked well in actual practice are ferrous salts, illustrated by ferrous sulfate, ferrous chloride and the like. Other bath soluble iron salts that can be employed are soluble ferrous fluoroborate or sulfamate and generally related compounds.

The iron complexing agent employed in the present invention is naturally bath soluble and is selected from the group consisting of carboxy and hydroxy groups provided that at least one of the complexing groups is a carboxy group and further provided that there are at least two complexing groups present. The complexing agent that may be employed is present in an amount generally ranging from about 10 to about 100 g/l. Suitable complexing agents are hydroxy substituted lower aliphatic carboxylic acids having from 2 to 8 carbon atoms, from one to six hydroxyl groups and from one to three carboxyl groups such as citric acid, malic acid, glutaric acid, gluconic acid, muconic, glutamic, glucoheptonate, glycolic, aspartic acid and the like. Iron can be introduced into the bath as a salt of the complexing agent.

By "carboxy" is meant by the group —COOH; however, the proton dissociates from the carboxy group in solution, and accordingly, is meant to be included in the meaning of carboxy.

The pH of the bath preferably ranges from about 2.5 to about 5.5. The temperature of the bath is desirably maintained from abut 120° to about 180° F, and at present an optimum bath temperature is approximately 150° F.

The average cathode current density may range from about 10 amperes to approximately 70 amperes per square foot, and preferably is about 40 amperes per square foot.

It is preferred that the complexing agent concentration be at least about three times the total iron ion concentration in the bath. The complexing agent concentration ratio to total iron ion concentration may range from 3:1 to 50:1.

As was described earlier, the bath may be utilized with or without agitation, and the type of agitation can be accomplished by any practical method, such as air, mechanical, or hydraulic means. As was also pointed out hereinabove, the present invention contemplates that the reduction in iron content can be achieved by stages of more than two steps, and illustratively, air agitation may be used for the layer of high iron content, moderate agitation as a second step to reduce the iron content, and essentially no agitation for the lower iron content in the final layer just prior to the nickel strike.

Essentially any brightening agent can be used in the bath to impart brightness, ductility and leveling in the iron-nickel deposits. To enumerate, the brightening agents may be sulfo-oxygen compounds, acetylenic nickel brighteners, organic sulfides of the type described in U.S. Pat. No. 3,806,429, or similar materials. Naturally, these brighteners must be soluble in the electroplating bath.

The uppermost layer in accordance with this invention is a microdiscontinuous chromium electrodeposit. As used herein, "microdiscontinuous" generically refers to a chromium deposit having a multiplicity of micro-apertures. Within this definition of microdiscontinuous, there is embraced a micro-porous surface wherein the micro-apertures are pores generally ranging from about 60,000 to 500,000 per square inch. Also, microdiscontinuous refers to a microcracked surface in which the micro-apertures are cracks and they range from approximately 300 to 2,000 cracks per linear inch.

It is thus to be seen that the top chromium layer has micro-apertures with respect to the layer below. The microdiscontinuity may be obtained by the deposition of nickel containing micro-fine inorganic particles. Microdiscontinuity can also be induced by electrodepositing the lower nickel layer in such a state that it will be microcracked and the subsequently deposited chromium layer will thereby be plated in a microcracked manner as is fully described in U.S. Pat. No. 3,761,363. Another way to obtain microdiscontinuity is disclosed in U.S. Pat. No. 3,563,864, wherein the nickel deposit is electrochemically laid on in such a fashion that the nickel deposit microcracks during or after the chromium deposition, thereby resulting in a microcracked chromium deposit. It has also been demonstrated that a copper-bright nickel-iron deposit when plated with the conventional continuous chromium layer does not perform as effectively as microdiscontinuous chromium.

Prior to setting forth by specific examples the highly desirable results achieved by this invention, it is desired to note that various other additives may be employed to effect the results desired, as by the addition of surface active agents which are effective to overcome in particular situations such undesirable properties as pitting or the like. Additionally, it is to be observed that when significant amounts of iron are used, it is preferred that soluble anodes of iron or nickel-iron alloy anodes should be employed. Perferably, the ratio of nickel to iron in the anode area should be maintained at approximately eight to one.

The markedly improved results accomplished by proceeding in accordance with the teachings of this invention will be more fully understood when reference is made to the following examples.

EXAMPLE I

A layer of copper 15 μm in thickness was plated on a steel substrate followed by a layer of nickel-iron containing about 21% by weight iron in which the nickel-iron was plated to approximately a thickness of 15 μm. A second layer of nickel-iron containing about 9% by weight of iron was plated over the first nickel-iron layer to a thickness of approximately 5 μm. Nickel with inorganic inclusions was plated over the aforementioned layers and a layer of chromium plated thereon which rendered it microdiscontinuous because of the inorganic particles in the prior nickel deposit. The nickel with the inorganic inclusions was plated to a thickness of approximately 3 μm and the chromium was held to a thickness of approximately 0.35 μm. The plated part was exposed to the elements at Kure Beach, N. C. for about 40 days and for 75 days in Detroit, Mich. on the roof of a factory.

The ASTM [B 537] rating for the part after the exposure test stated was 10/9 in which the first member denotes protection of the substrate and the second number is descriptive of appearance. To clarify, a perfect corrosion specimen showing no deterioration rated 10/10. Progressive degrees of failure are denoted by lower numbers. A rating below seven for either protection or appearance is deemed to be unsatisfactory.

EXAMPLE II

A steel panel was plated with 15 μm of copper followed by an electrodeposited nickel-iron layer of about 15 μm thickness containing 22% iron by weight with air agitation. A second nickel-iron layer was plated over the first, however, only approximately 9% iron was present and it was plated to 5 μm thickness. A nickel deposit containing inorganic particles was then plated to about 3 μm thickness and a microporous layer of chromium was applied to a thickness of approximately 0.4 μm. The panel was exposed at Kure Beach for 11 months. The panel was rated at 10/9 after exposure using the ASTM rating system.

A second panel was prepared precisely as the first except that the nickel-iron layer containing 9% iron was plated before the 22% iron layer. The panel was exposed at Kure Beach along with the above panel and after 11 months exposure was rated at 10/6, showing that it is important that the higher iron concentration in the nickel-iron plating be electrodeposited prior to the lower percentage iron containing layer in order to achieve a highly durable and extremely attractive appearance without staining.

EXAMPLE III

Steel panels prepared in the manner described in Example II were exposed at a severe industrial site in Detroit, Mich. for 15 months.

The test results at this location also indicated the importance of having a lower iron content in the top layer of nickel-iron alloy. The results at Detroit showed that the ASTM rating for the test panel having 9% iron in the top alloy layer was 10/7, while the test panel having 22% iron in the top or final nickel-iron layer had an ASTM rating of 10/4.

Both panels protected the steel substrate perfectly, but the panel with the lower iron in the top of final alloy layer had a significantly better appearance rating of 7 versus 4 for the other test panel. This improvement in appearance rating numbers shows that substantially less staining occurred in the recommended system of plating deposits.

EXAMPLE IV

Two panels were produced, each of which had a first electroplated layer of bright nickel-iron containing 20.5 to 24.3 percent iron plated to a thickness of 17.5 μm. A second layer of bright-nickel iron containing 9.0 to 10.0 percent iron was plated over the first alloy layer. Nickel with inorganic inclusions was plated over the aforementioned layers with different thicknesses on different panels. Finally, chromium was plated over the nickel layers to a thickness of 0.25 μm. The chromium was microporous due to the inorganic inclusions in the nickel layer. After approximately three months exposure in a relatively severe industrial environment, the test panels were examined to determine the effect of the thickness of the nickel layer in retaining a good appearance of the decorative deposits.

The influence of the thickness of the nickel layer is illustrated very well by the ratings of the panels using the ASTM rating system. With a thickness in the nickel layer of 1.75 μm, the rating was 10/5, while when the nickel layer was 3.25 μm thick, the rating was 10/9. An appearance rating of 9 versus a rating of 5, indicates a very significant improvement with a relatively thicker nickel deposit overplated on the alloy deposit.

Various changes and modifications to the formulations and procedures have been described herein, and these and others can of course be practiced without departing from the spirit of the invention or the scope of the subjoined claims.

What is claimed is:

1. A composite electroplated article, which comprises a metallic substrate, a first layer of nickel-iron alloy plated on said substrate and said first layer having an iron content of from about 15 to 40% by weight and a nickel content of from about 85 to 60% by weight, a second layer of nickel-iron alloy plated on said first layer and said second layer having an iron content of between about 5 and 14% by weight and a nickel content from approximately 95 to 86% by weight, a nickel layer electrodeposited on said second layer, and a layer of microdiscontinuous chromium bonded to the nickel layer.

2. An electroplated article as defined in claim 1, in which the lowermost nickel-iron layer is approximately 10 μm or more.

3. A composite nickel-iron electroplated article as defined in claim 1, in which the uppermost nickel-iron layer is approximately 2.5 μm or more.

4. A composite nickel-iron electroplated article as defined in claim 1, wherein the nickel layer has inclusions therein in the form of inorganic particles.

5. A composite nickel-iron electroplated article as defined in claim 1, wherein said substrate comprises a layer of copper upon which the lowermost layer of nickel-iron alloy is plated.

6. A composite nickel-iron electroplated article as defined in claim 1, wherein the microdiscontinuous chromium layer bonded to the nickel layer is microcracked.

7. A composite nickel-iron electroplated article as defined in claim 1, wherein the nickel layer is microcracked.

8. A composite nickel-iron electroplated article as defined in claim 1, wherein the nickel layer microcracks when a subsequent chromium layer is plated thereon.

* * * * *